US007758428B2

(12) United States Patent
Mattice et al.

(10) Patent No.: US 7,758,428 B2
(45) Date of Patent: Jul. 20, 2010

(54) METHOD AND APPARATUS FOR CONTROLLING ACCESS TO AREAS OF GAMING MACHINES

(75) Inventors: Harold Mattice, Gardnerville, NV (US); Joseph R. Hedrick, Reno, NV (US); Chan W. Griswold, Reno, NV (US)

(73) Assignee: IGT, Reno, NV (US)

( * ) Notice: Subject to any disclaimer, the term of this patent is extended or adjusted under 35 U.S.C. 154(b) by 1639 days.

(21) Appl. No.: 09/824,621

(22) Filed: Apr. 2, 2001

(65) Prior Publication Data

US 2002/0142831 A1 Oct. 3, 2002

(51) Int. Cl.
*A63F 9/24* (2006.01)

(52) U.S. Cl. ..... 463/46; 70/264

(58) Field of Classification Search ..... 463/29, 463/20, 46, 25; 273/143 E; 194/350–351; 70/264

See application file for complete search history.

(56) References Cited

U.S. PATENT DOCUMENTS 3,584,486 A * 6/1971 Trip et al. ..... 70/271
3,763,676 A * 10/1973 Schachter et al. ..... 70/264
3,774,422 A * 11/1973 Hogan et al. ..... 70/264
3,796,073 A * 3/1974 Guiraud ..... 70/134
3,919,869 A * 11/1975 Fromm ..... 70/263
4,072,930 A * 2/1978 Lucero et al. ..... 340/152 T
4,887,445 A * 12/1989 Beatty ..... 70/278.7
5,093,861 A * 3/1992 Graham ..... 713/185
5,371,345 A * 12/1994 LeStrange et al. ..... 235/380
5,392,025 A * 2/1995 Figh et al. ..... 340/547
5,588,317 A * 12/1996 Bianco ..... 70/265
5,774,058 A * 6/1998 Henry et al. ..... 340/5.5
5,876,285 A 3/1999 Salour et al. ..... 402/29
5,890,439 A * 4/1999 McGunn ..... 109/47
5,923,249 A 7/1999 Muir ..... 40/545
5,954,583 A 9/1999 Green ..... 463/29
5,984,784 A 11/1999 Ho ..... 463/29
6,439,996 B2 * 8/2002 LeMay et al. ..... 463/29
6,641,483 B1 * 11/2003 Luciano et al. ..... 463/46

* cited by examiner

*Primary Examiner*—Corbett B Coburn
(74) *Attorney, Agent, or Firm*—George H. Gerstman; Seyfarth Shaw LLP

(57) ABSTRACT

An apparatus and method affords, to authorized persons, access to one or more lockable areas of one or more gaming machines. Each area includes a door or switch and an associated electrically operable lock mechanism which controls access to the area. Each machine has a local processor communicating with a central host computer and with lock processors for each of its lockable areas. Personnel identification and access authorization data is stored at the host computer. Data may also be stored on personal data cards, respectively assigned to individual persons. A person seeking access inputs identification data at the machine, and the host computer responds with signals to unlock lock mechanisms for areas which the identified person is authorized to access. Each machine monitors the states of all of its locks and doors. A manual override key, disabled when power is on, operates the lock mechanisms when power is off.

3 Claims, 7 Drawing Sheets

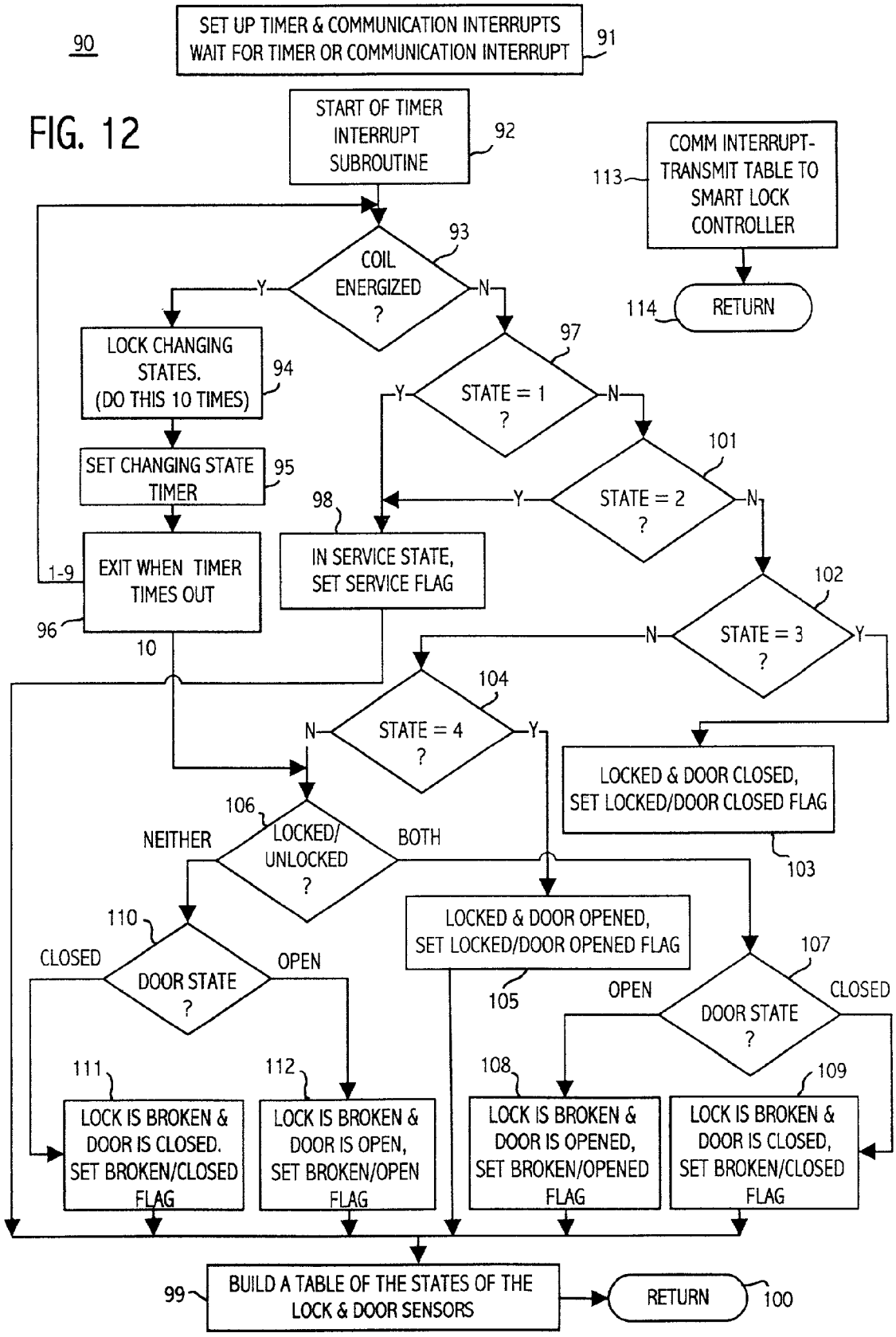
90
SET UP TIMER & COMMUNICATION INTERRUPTS
WAIT FOR TIMER OR COMMUNICATION INTERRUPT
91
FIG. 12
START OF TIMER INTERRUPT SUBROUTINE
92
COMM INTERRUPT-TRANSMIT TABLE TO SMART LOCK CONTROLLER
113
RETURN
114
COIL ENERGIZED ?
93
Y
N
LOCK CHANGING STATES. (DO THIS 10 TIMES)
94
SET CHANGING STATE TIMER
95
EXIT WHEN TIMER TIMES OUT
1-9
96
10
STATE = 1 ?
97
Y
N
IN SERVICE STATE, SET SERVICE FLAG
98
STATE = 2 ?
101
Y
N
STATE = 3 ?
102
N
Y
STATE = 4 ?
104
N
Y
LOCKED & DOOR CLOSED, SET LOCKED/DOOR CLOSED FLAG
103
LOCKED/ UNLOCKED ?
106
NEITHER
BOTH
LOCKED & DOOR OPENED, SET LOCKED/DOOR OPENED FLAG
105
DOOR STATE ?
110
CLOSED
OPEN
DOOR STATE ?
107
OPEN
CLOSED
LOCK IS BROKEN & DOOR IS CLOSED. SET BROKEN/CLOSED FLAG
111
LOCK IS BROKEN & DOOR IS OPEN, SET BROKEN/OPEN FLAG
112
LOCK IS BROKEN & DOOR IS OPENED, SET BROKEN/OPENED FLAG
108
LOCK IS BROKEN & DOOR IS CLOSED, SET BROKEN/CLOSED FLAG
109
BUILD A TABLE OF THE STATES OF THE LOCK & DOOR SENSORS
99
RETURN
100

METHOD AND APPARATUS FOR CONTROLLING ACCESS TO AREAS OF GAMING MACHINES

BACKGROUND

This application relates to gaming machines or terminals and security provisions therefore. In particular, the application relates to improved methods and apparatus for affording to authorized persons access to secure areas of gaming machines.

Gaming machines or terminals, such as slot machines, typically include a number of secure or locked areas which are accessible only to authorized personnel. As used herein "area" may refer to a region closed by a door, or a lockable device, such as a switch. Such areas may include storage hoppers and overflow "drop" boxes for coins, currency, tokens or other valuable items used in playing a game, bill or ticket storage stackers, operating mechanisms, electronic control panels, auxiliary equipment such as printers, and so forth. Access to a given machine may be required from time to time by any of a number of different persons, e.g., currency-handling personnel for filling and emptying coin hoppers, drop boxes or bill stackers, service personnel for performing routine maintenance or service functions, repair technicians for correcting malfunctions, and the like. Since most such personnel require access to fewer than all of the available secure areas of a machine, and since it is desired to limit access to machine areas as much as possible for security reasons, it is necessary to provide each such area with a separate lock. Heretofore, such locks have been mechanical devices which are unlocked with a mechanical key. Thus, for any given machine, a number of different keys may be required, and it may be necessary to provide multiple copies of any one key for different personnel, who may require access to an area for different reasons, or who work different shifts, or the like.

The existence of a large number of keys in circulation is an inherent security risk. Furthermore, when a gaming establishment needs to access many machines at a time, such as to do hopper fills or drop box services, most of the service time is spent searching for the proper keys to unlock the machines, which is inefficient and costly. Also, each time an employee leaves the employ of a gaming establishment, the gaming machines or areas thereof to which the employee had access must be re-keyed. This can constitute a significant expense.

SUMMARY

There is disclosed herein a method and apparatus for selectively controlling access to one or more areas of a gaming machine, which avoids the disadvantages of prior techniques while affording additional structural and operating advantages.

An important aspect is the provision of a method and apparatus of the type set forth which is characterized by significantly increased security.

Another aspect is the provision of a method and apparatus of the type set forth which affords significant economies of time and money.

An important aspect is the provision of a method and apparatus of the type set forth which minimizes the need for mechanical keys.

In connection with the foregoing aspect, another aspect is the provision of an apparatus which utilizes electrically operable lock mechanisms under control of processors programmed to respond to the input of personnel identification data by a person seeking access to a machine, to provide access to only those areas for which the person is authorized.

Another aspect is the provision of an apparatus of the type set forth, wherein a plurality of gaming machines may be in communication with and under common control from, a host computer.

A further aspect is the provision of an apparatus of a type set forth with a mechanical override which can be used in the absence of electrical power or in the event of malfunction or other emergency.

In connection with the foregoing aspect, a further aspect is the provision of an apparatus of the type set forth, wherein the mechanical override is normally disabled when the gaming machine is normally electrically powered.

In connection with the foregoing aspects, a further aspect is the provision of an apparatus of the type set forth, which provides an indication when the override has been utilized.

Another aspect is the provision of a system of the type set forth which monitors the states of all gaming machine doors and lock mechanisms.

Certain ones of these and other aspects may be attained by providing apparatus for selectively controlling access to one or more of plural areas of a gaming machine, the apparatus including plural electrically operable lock mechanisms respectively associated with the areas and movable between unlocked and locked conditions relative to the areas; control circuitry including a processor operating under control of a stored program and coupled to each of the lock mechanisms for controlling operation thereof; a data storage and retrieval system adapted to communicate with the processor and including a storage medium for storing data including personnel identification data and access authorization data indicative of the areas, if any, of the machine for which a person seeking access to the machine is authorized; and a data input device coupled to the processor for inputting at least personnel identification data identifying a person seeking access to the machine, the processor being responsive to input personnel identification data for operating one or more lock mechanisms in accordance with access authorization corresponding to an identified person.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

FIG. 12 is a flow chart diagram of program software for a lock processor of a gaming machine of FIG. 1.

DETAILED DESCRIPTION

Figure 1:
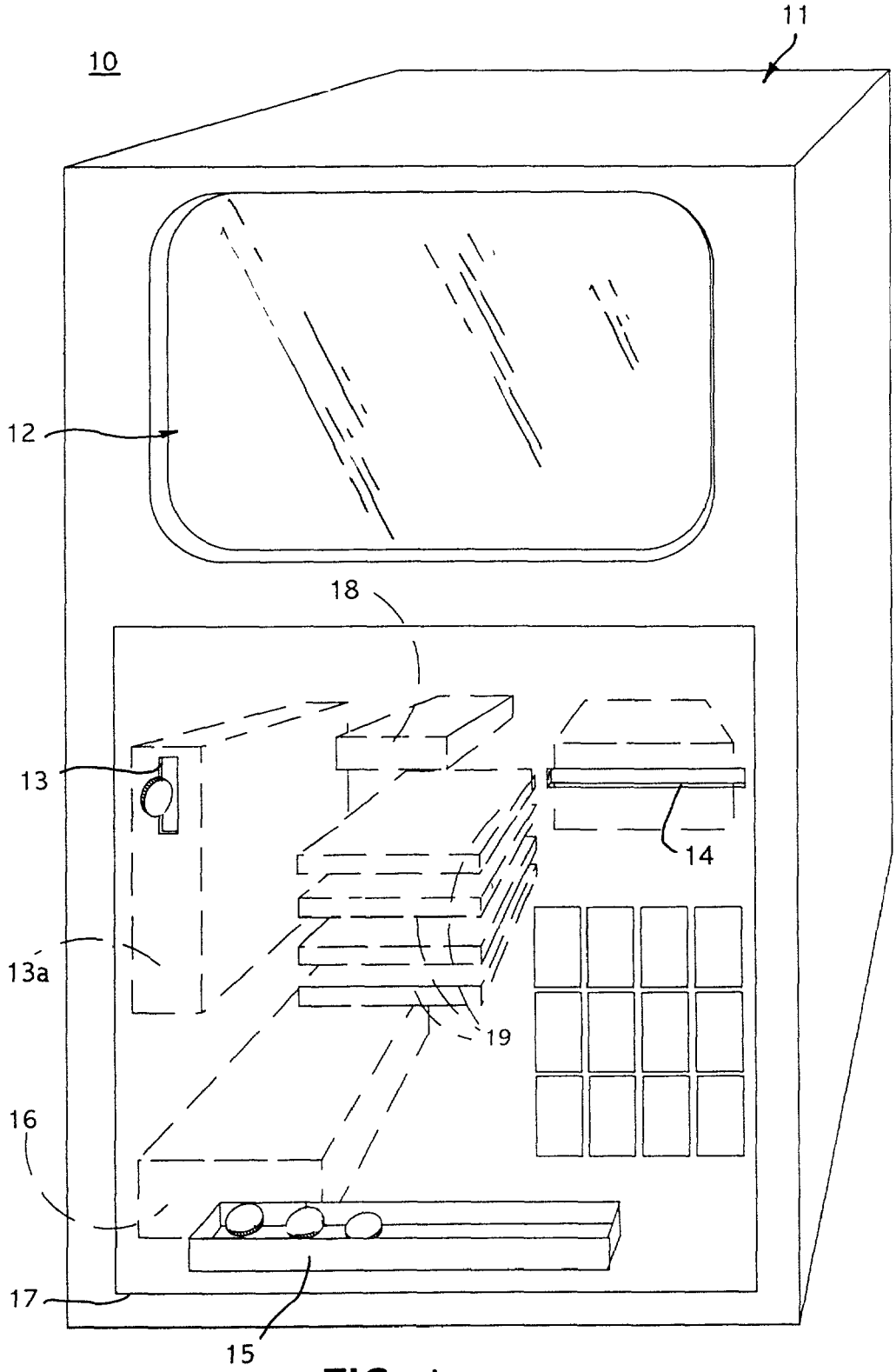
FIG. 1 (PRIOR ART)
FIG. 1 is a perspective view of a prior art gaming machine.

Referring to FIG. 1, there is illustrated a prior art gaming machine or terminal 10 having a housing 11 provided with a display area 12. Depending upon the type of gaming machine and the nature of the game, there may be provided a number of user interface devices, which may include a button array or key pad, touch screen, joy stick, lever arm, or the like. The machine 10 may include a coin or token slot 13 for receiving the player's wagers and which communicates with an associated hopper 13*a*. Also, depending upon the nature of the machine, it may include a bill or card slot 14 for receiving player wagers, which is typically provided with an associated bill or card validator (not shown) and a bill or card stacker 14*a*. There may also be provided a payout bin 15 for receiving dispensed payout of coins or tokens, and/or a printer 15*a* associated with a dispensing slot for dispensing cards, bills or the like. Typically, a drop box 16 is provided for receiving overflow from the hopper 13*a*.

Access to the interior of the gaming machine 10 may be provided through a main door 17 which includes an associated manual, key-actutable lock mechanism. In addition, a number of the other elements of the machine, such as the hopper 13*a*, the stacker 14*a*, the printer 15*a*, and the drop box 16 may also be provided with manual lock assemblies, and may be accessible from inside or outside of the machine 10. In addition, there may be provided certain switches, such as a privilege switch 18, provided with an associated lock, and one or more circuit boards 19, which may be provided with associated lock assemblies for controlling enablement thereof.

Figure 2:
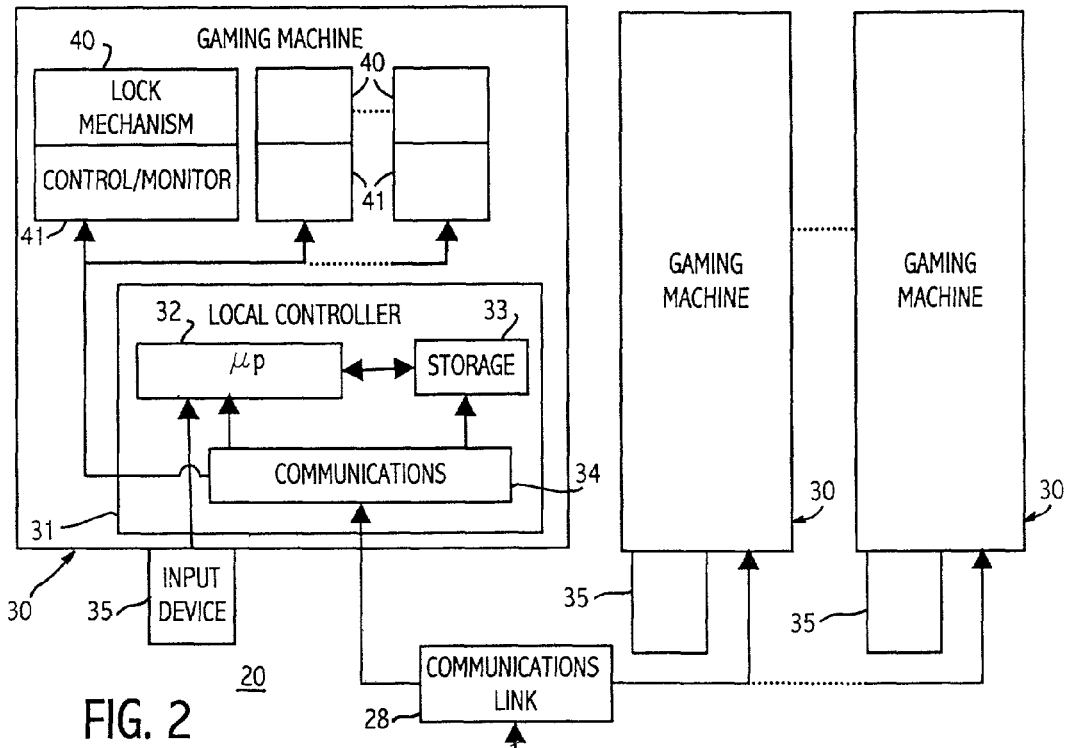
FIG. 2 is a functional block diagram of system for controlling access to gaming machines.

Referring to FIG. 2, there is illustrated an access control system 20 for a plurality of gaming machines 30 under common control of the a computer 21. Each of the gaming machines 30 may be generally the same type as the gaming machine 10, described above, except that instead of having mechanical, key-actuated lock assemblies, it is provided with electrically operated lock mechanisms, as will be described more fully below.

The host computer 21, which may be located in a central location in a gaming establishment, includes a processor 22, which may comprise one or more microprocessors, and an memory or associated storage device 23 on which may be stored a database 24 including identifications of all of the gaming machines 30, as well as personnel identification data for all applicable personnel, and access authorization data indicating which, if any, lockable areas of which machines 30 each person is authorized to access. The processor 22 is coupled to a communications circuit 25 for communication with other devices. The host computer 21 may also be provided with one or more input devices 26, which may include a keyboard, mouse or the like, as well as a display 27, which may include a CRT or LCD display screen or other types of display devices. Additionally, if desired, other accessory devices, such as printers, modems, speakers, etc. may be coupled to the host computer 21 in a known manner. The communications circuit 25 is coupled through a communication link 28 to each of the gaming machines 30. The communication link 28 may be a wired link, such as a cable network or the like, or a wireless link, such as an RF link.

While internal details have been illustrated on only one of the gaming machines 30 in FIG. 2, it will be appreciated that similar details are included in each of the gaming machines 30 and, while only three such machines are depicted in FIG. 2, the dotted lines between the last two machines signifies that there may be any number of intervening machines therebetween. The gaming machines 30 may be of the same or of different types, but all will include features similar to those illustrated in the first machine 30.

Figure 4:
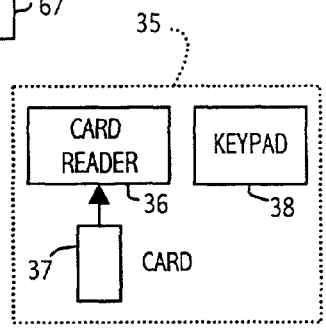
FIG. 4 is a functional block diagram of an embodiment of data input device for a gaming machine of FIG. 2.

In particular, each gaming machine 30 includes a local controller 31 which may include a processor 32, such as a suitable microprocessor, coupled to an associated memory or storage device 33 and to a communications circuit 34 which is, in turn, coupled to the communications link 28. The machine 30 is provided with an input device 35 coupled to the processor 32 for user input of information. Referring to FIG. 4, the input device 35 may include a suitable card reader 36 for reading data on a personal data card 37. Each applicable person may be provided with a personal identification card, which may contain personal identification data which identifies that person. When a person seeks access to a particular machine 30, the personal identification card 37 is inserted in the card reader, which reads the data therefrom and transmits it to the processor 32. The input device 35 may also include a keypad 38 for user input of information, such as a PIN number, to confirm identification and inhibit unauthorized use of another person's personal identification card. Alternatively, the input device 35 could include simply a key pad 38 for user input of all applicable identification information. The card reader 36 and card 37 may be magnetic devices. Alternatively, the card 37 may be a "smart" card with built-in electronics, in which case, the card reader 36 would be a suitable associated "smart" card reader. It will be appreciated that other types of input devices could also be used, including biometric identifiers, such as finger print readers, or the like.

Each gaming machine 30 also includes one or more lock mechanisms 40, each associated with one of the lockable "areas" described above. In the illustrated embodiment, three of the lock mechanism 40 have been shown in the first gaming machine 30 in FIG. 2, but the dotted lines between the last two lock mechanism 40 indicate that any number of intervening lock mechanism 40 may be disposed therebetween. It will also be appreciated that fewer than three lock mechanism 40 may be provided in certain machines. Each lock mechanism 40 has associated therewith control/monitor circuitry 41, which is coupled to the communications circuit 34 of the local controller 31.

Referring in FIGS. 3 and 5-7B, there are illustrated details of a lock mechanism 40 and the control/monitor circuitry 41 thereof for a typical lockable area, in this case the access to the area being controlled by a door 50 on which the lock mechanism 40 is mounted. The lock mechanism 40 includes a lock bolt 42 in the form of an elongated member provided with a tapered cam surface and 43 at one end thereof (see FIG. 7A). The bolt 42 may be substantially rectangular in transverse cross section and may be provided with a rectangular slot 44 for receiving an associated magnet 45 adapted for cooperation with an associated electromagnetic coil 45*a* for controlling reciprocating movement of the bolt 42 in locking (toward the right) and unlocking (toward the left) directions, as viewed in the figures, depending upon the direction of electrical current through the coil, all in a known manner. The bolt 42 may be provided with a projecting pin 42*a*, for a purpose to be described below, and is also provided along one face with a pair of spaced-apart detent recesses 46 and 47. Formed transversely through the bolt 42 are two longitudinally spaced-apart bores 48 and 49. The door 50 is movable between open (not shown) and closed positions relative to an associated door jamb 51 which includes suitable keeper structure for the bolt 42, which may include a lock slot 52 dimensional to receive the bolt 42.

There is also provided a detent ball 53 biased by a spring 54 into engagement with the lock bolt 42. When the bolt 42 is in its locked position, illustrated in FIG. 5, the detent ball 53 will engage in the detent recess 46 while, when the bolt 42 is in its unlocked position, illustrated in FIG. 6, the detent ball 53 will engage in the detent recess 47, thereby to prevent accidental movement of the bolt 42 from these positions.

Figure 8A:
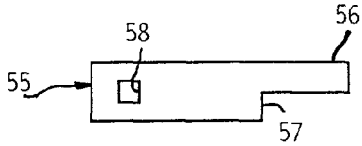
FIGS. 8A and 8B are top plan and front elevational views of a manual override unlocking cam for the lock mechanism of FIGS. 5-7.
Figure 8B:
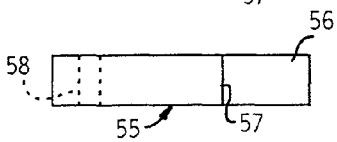

Referring also to FIGS. 8A and 8B, the lock mechanism 40 may also include a manual override unlocking cam 55 having an arm 56 projecting from one end thereof and cooperating with the main body of the cam to define a shoulder 57. Formed through the cam 55 is a key aperture 58 which, for simplicity, is illustrated as square in shape, although it will be appreciated that it could have any desired shape. The unlocking cam 55 is disposed adjacent to the bolt 42 for pivotal movement relative thereto, as will be explained more fully below.

The control/monitor circuitry 41 includes a lock processor 60 (see FIG. 3), which may be a suitable microprocessor, which communicates via a communications circuit 60*a* with the local controller 31, as explained above. Mounted on the door 50 is an optical door emitter 61 and an optical door receiver 62. Mounted on the door jamb 51 is a prism 63, which is positioned so as to be opposite the emitter and receiver 61 and 62 when the door 50 is in its closed position, illustrated in the drawings. The emitter 61 may be an LED and the receiver 62 may be a suitable light sensor, such as a photocell or the like. When the door 50 is in its closed positioned, the emitter 61 emits a light beam which passes into the prism 63 and is internally reflected thereby back to the receiver 62 along an optical path indicated by the broken line in FIG. 5. When the door 50 is not in its closed position, the optical path between the emitter 61 and the receiver 62 will be interrupted.

Figure 5:
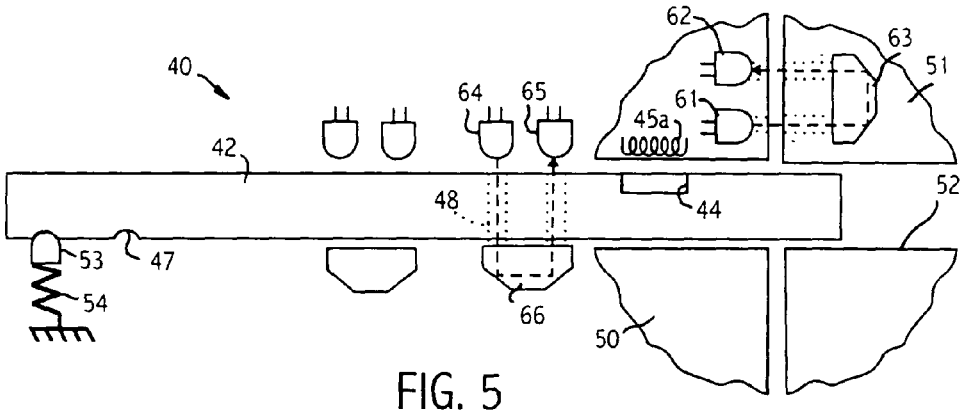
FIG. 5 is a diagrammatic top plan view of a door lock mechanism and associated sensing apparatus for a door of a gaming machine of FIG. 1, with the door in its closed condition and the lock bolt in its locked condition.
Figure 6:
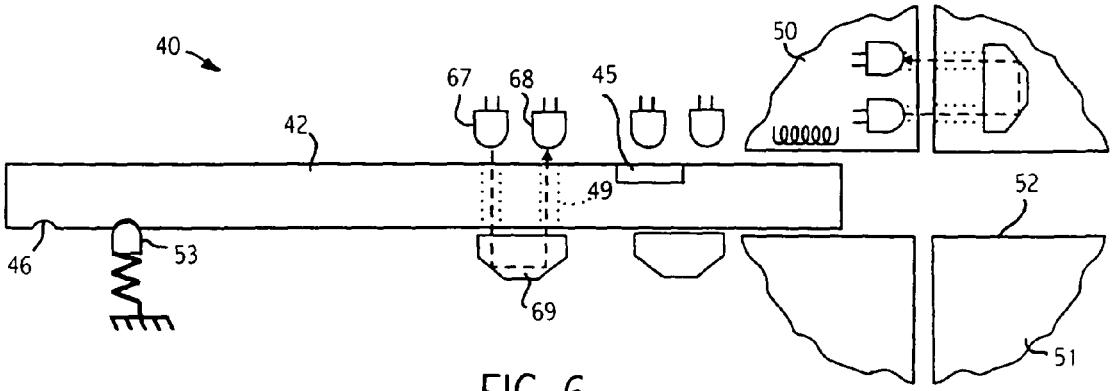
FIG. 6 is a view similar to FIG. 5, with the lock bolt in its unlocked condition.
Figure 7A:
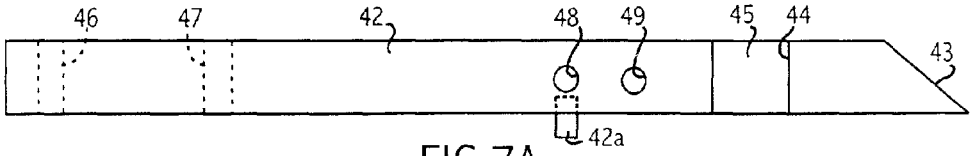
FIGS. 7A and 7B are rear elevational and top plan views of the lock bolt of FIG. 5.
Figure 7B:
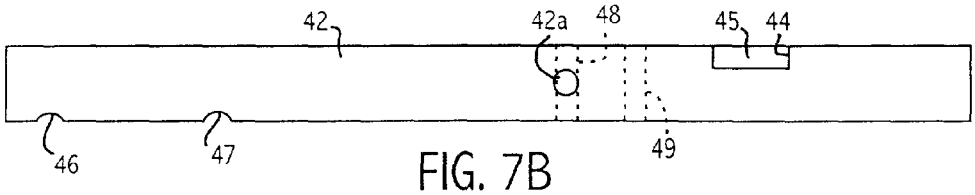

The control/monitor circuitry 41 also includes a similar bolt locked emitter 64 and a bolt locked receiver 65 cooperating with an associated prism 66 so that, when the bolt 42 is in its locked position illustrated in FIG. 5, a light beam emitted from the emitter 64 will pass through the bore 48 into the prism 66 and back through the bore 49 to the receiver 65. This optical path will be interrupted when the bolt 42 is not in its locked position. There is also provided a bolt unlocked emitter 67 and a bolt unlocked receiver 68 cooperating with a prism 69 so that, when the bolt 42 is in its unlocked position, illustrated in FIG. 6, a light path will be established from the emitter 67 through the bore 49 into the prism 69 and back through the bore 48 to the receiver 68. This path will be interrupted when the bolt 42 is not in its unlocked position.

Figure 3:
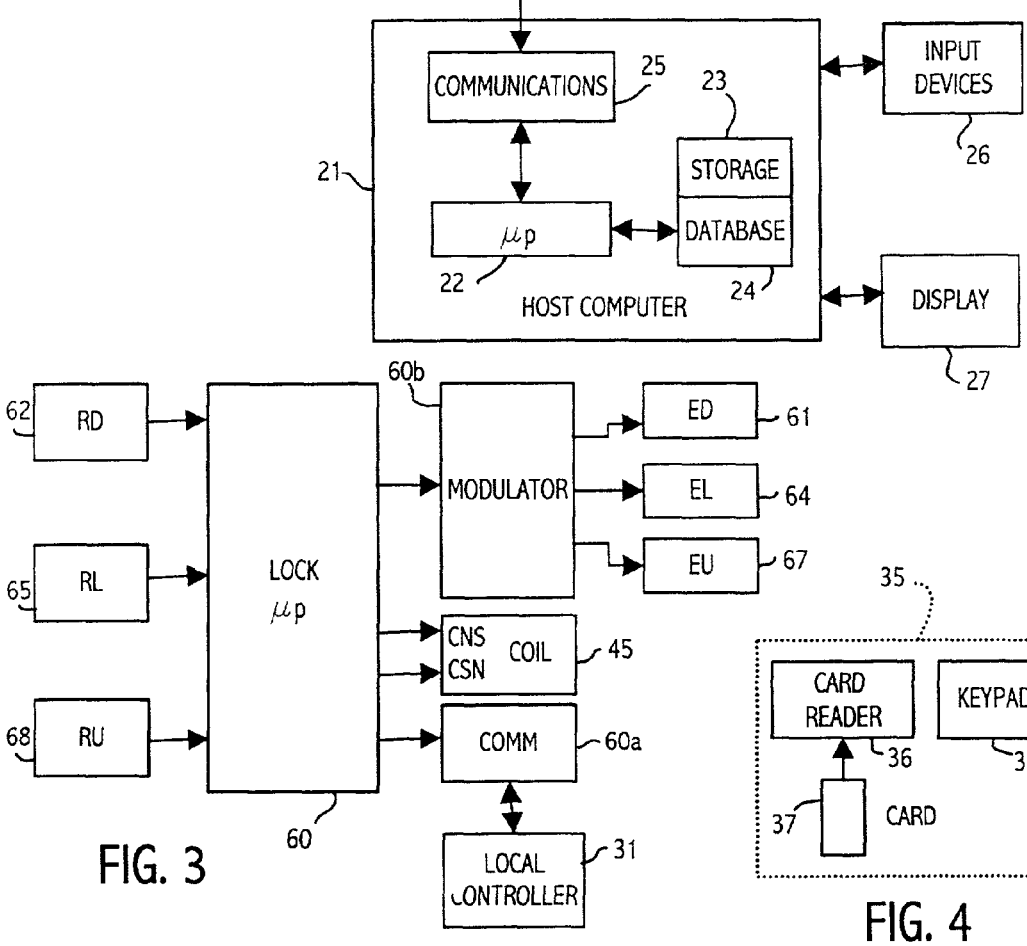
FIG. 3 is a functional block diagram of a lock processor and associated elements of control/monitor circuitry of a gaming machine of FIG. 2.

As can be seen in FIG. 3, the optical emitters 61, 64 and 67, the optical receivers 62, 65 and 68 and the coil 45*a* are all coupled to the lock processor 60. It is a significant aspect of the system 20 that the optical emitters 61, 64 and 67 can be modulated and, to this end, they are all connected to a modulator 60*a* which is, in turn, connected to the lock processor 60. The modulation of the light beams generated by the emitters could be of any of a number of different types, but may be as simple as intermittently operating the emitters in patterns which may be predetermined but are preferably random, with random on times and random off times. This greatly enhances the security of the system by minimizing the possibility of blinding the optical receivers with an external light source. The software of the lock processor 60 can, for example, signal an error or alarm condition if a receiver is receiving when its associated transmitter is not transmitting or, when the associated door or lock bolt is in a position wherein the optical path should be completed, the receiver is not receiving when its associated emitter is transmitting.

It will be understood that the particular type of lock mechanism structure shown on the drawings is simply for purposes of illustrating the applicable principles, and that other known lock mechanism structures could also be utilized.

While the illustrated embodiment utilizes optical emitters and receivers for the door and lock bolt monitoring functions, it will be appreciated that other types of position-sensing devices could be utilized, although for some such devices the modulation function may not be feasible. Also, while a locking mechanism for a door has been described in detail, it will be appreciated that the locking mechanism for other types of lockable "areas" in the gaming machine 30 could use other known types of condition sensing or detecting devices.

In operation, it would be appreciated that the lock processor 60 can determine from the conditions of the emitters and receivers whether or not a door is in its closed position, and whether a lock bolt is in its locked position, unlocked position or neither, and this information can be communicated to the local controller 30 and then to the host computer 21.

The operation of the electrically operated locking mechanism described above is dependent upon the presence of electrical power. It is, of course, possible to provide a battery back-up system in the event of failure of the local power supply, but that is of limited utility. It is desirable to have a means for operating the lock mechanism 40 in the absence of a power supply, such as in the event of a power outage or when a gaming machine is removed for service or inspection, as at a gaming control board facility, and not connected to a power supply. Referring to FIGS. 8A, 8B and 9A-9D, there is provided a manual override unlocking mechanism utilizing the mechanical unlocking cam 55 of FIGS. 8A and 8B, the shoulder 57 and arm 56 of which are diagrammatically illustrated in FIGS. 9A-9D. When the lock bolt 42 is disposed in its locked condition, illustrated in FIG. 9A, the unlocking cam 55 is disposed for pivotal movement about an axis substantially parallel to the pin 42*a* in a counter clockwise direction, illustrated by the arrow. In this initial position, the arm 56 of the unlocking cam 55 is disposed for engagement with the lock bolt pin 42*a*, while the shoulder 57 is disposed for engagement with a pin 66*a* on the prism 66. The prism 66 is mounted for movement in directions parallel to the movement of the lock bolt 42. Thus, when a key is inserted in the key aperture 58 and the cam 55 is rotated in the direction of the arrow, both the lock bolt 42 and the prism 66 will be moved to the left, passing first through the intermediate positions illustrated in FIG. 9B and moving ultimately to the positions illustrated in FIG. 9C, wherein the lock bolt 42 is in its unlocked condition. Note that if the cam 55 is now rotated back in the opposite direction, it will have no effect on the lock bolt 42 or the prism 66, so that the door can be unlocked, but not locked with the override key.

Figure 9A:
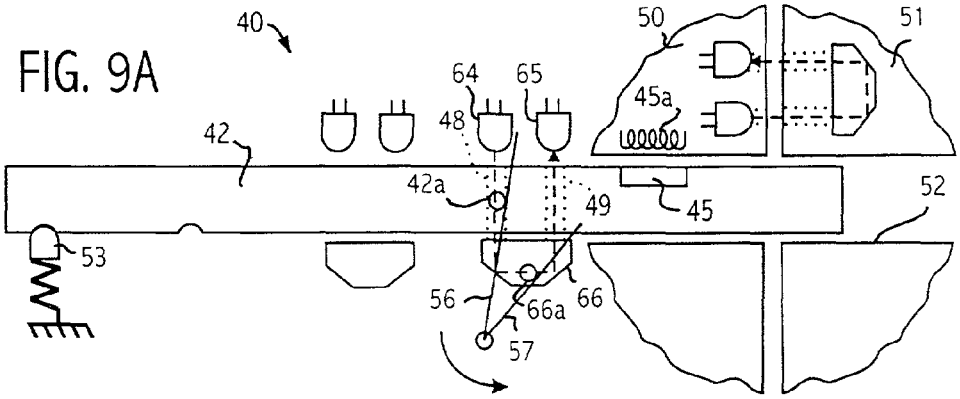
FIGS. 9A-9D are views similar to FIGS. 5 and 6 of the lock mechanism, illustrating various positions of the mechanism during unlocking with a manual override key and the unlocking cam of FIGS. 8A and 8B.
Figure 9B:
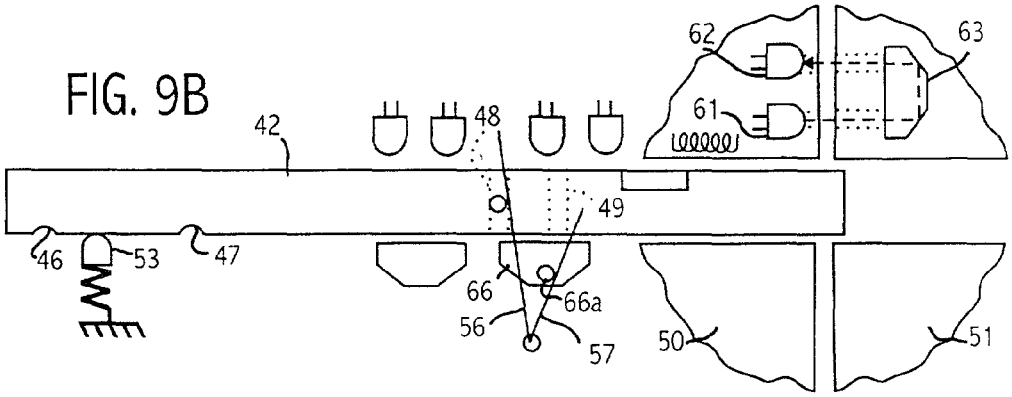
Figure 9C:
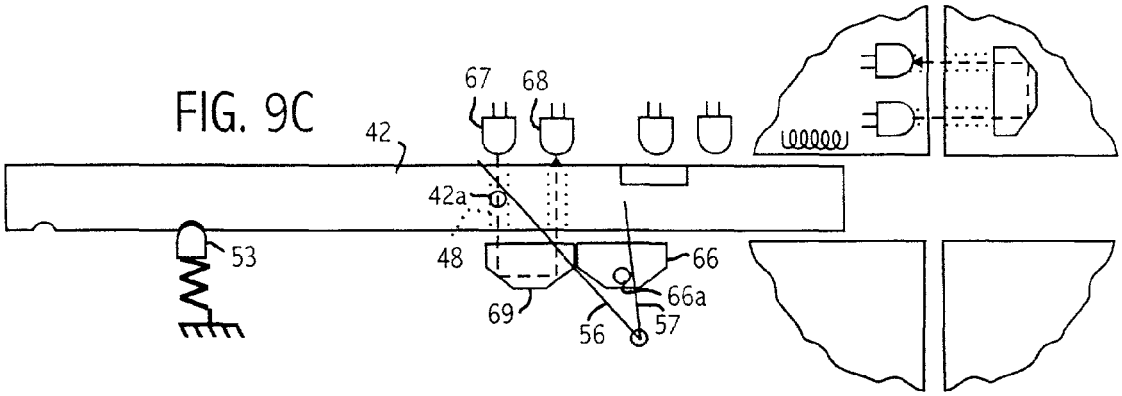
Figure 9D:
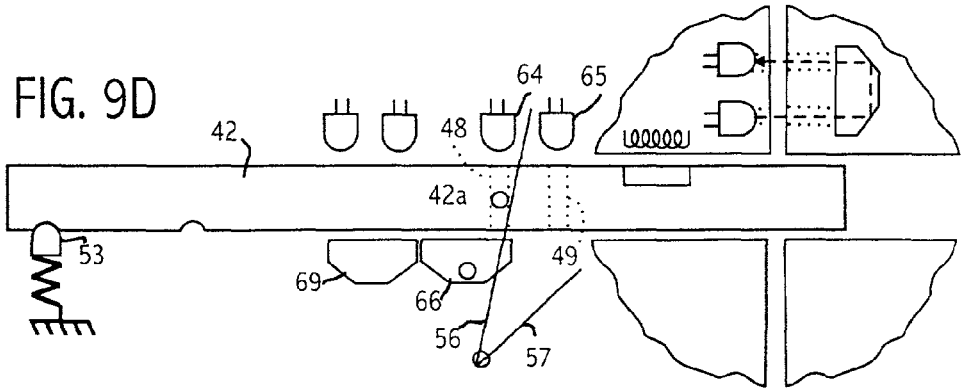

Another important aspect is that the system 20 can recognize if there has been unauthorized tampering with the machine 30 with an override key. Thus, when the lock bolt 42 is returned to its locked condition, such as by an electrical control signal, as illustrated in FIG. 9D, the prism 66 will remain in the position of FIG. 9C, so that the optical path between the emitter 64 and the receiver 65 will be interrupted. Thus, the system can immediately recognize that the override key has been used and appropriate steps can be taken. Once this fact is recognized, the prism 66 can be selectively or automatically reset to its normal position of FIG. 9A, as by use of a suitable solenoid.

Figure 13A:
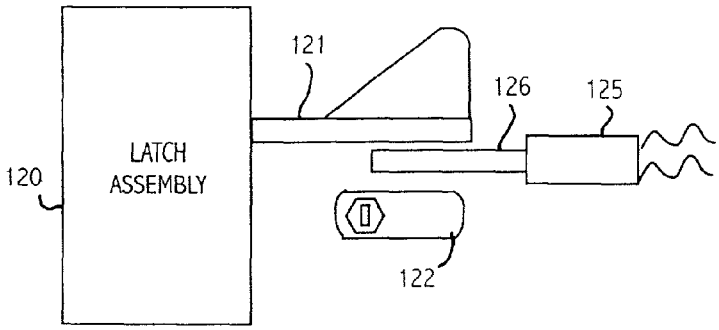
FIGS. 13A and 13B are diagrammatic views of a lock mechanism controlling enablement of a standard manual latch assembly.
Figure 13B:
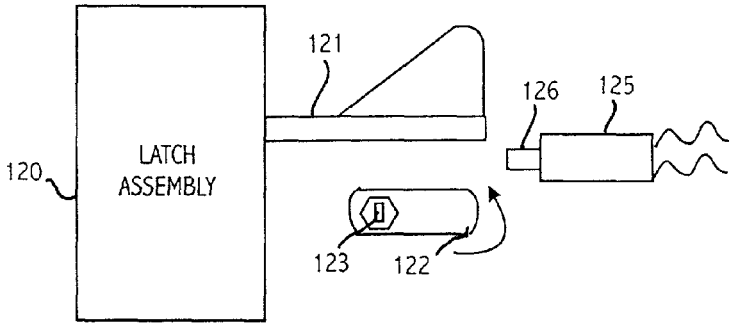

While the lock mechanism 40 and control/monitor circuitry 41 are designed to provide direct control of access to a lockable area of a gaming machine, by directly locking and unlocking a door or some other lockable device, it could also be utilized for indirect control of access. More specifically, in existing machines with standard mechanical latch assemblies, electrically controllable lock mechanisms could be utilized to control access by controlling the enablement and disablement of the standard mechanical latch assemblies. Referring to FIGS. 13A and 13B, there is illustrated a standard mechanical door latch assembly 120 having an actuating lever 121 and an associated lock cam 122 operable by an associated mechanical key (not shown) receivable in a key hole 123. Referring to FIG. 13B, in normal operation the key would be used to rotate the cam 122 in a counter clockwise direction to unlatch the door latch assembly 120 in a known manner. When the key is then rotated in the opposite direction, the actuator 121 returns to its original position to latch the assembly. The lock mechanism may include a solenoid 125 with a plunger 126 which is moveable between a retracted position shown in FIG. 13B, which does not interfere with the operation of the cam 122, and an extended position shown in FIG. 13A, blocking rotation of the cam 122 from its normal rest position. The system could be operated so that, when the solenoid 125 is de-energized, its plunger 126 is extended, thereby disabling the door latch assembly 120 and preventing access by use of the mechanical key. When the solenoid 125 is energized, the plunger 126 is retracted, permitting operation of the door latch assembly 120 by use of the mechanical key.

The arrangement of FIGS. 13A and 13B could be utilized in connection with the manual override unlocking cam 55 in the electrically controlled system described above in connection with FIGS. 9A-9D. In this case, the solenoid plunger 126 could be extended to block movement of the unlocking cam 55 when the solenoid 125 is energized, which would normally be the case whenever the system 20 is powered up and retracted in the event of a power loss to permit the use of the override key. Thus, it would not be possible for someone to attempt to tamper with the gaming machine using an override key when the system 20 was powered.

While, in the embodiment described above, the lock bolt 42 is moved by a coil and magnet arrangement, it will be appreciated that other types of electrically controlled motive devices could be utilized. For example, a stepper motor could be utilized.

Figure 11:
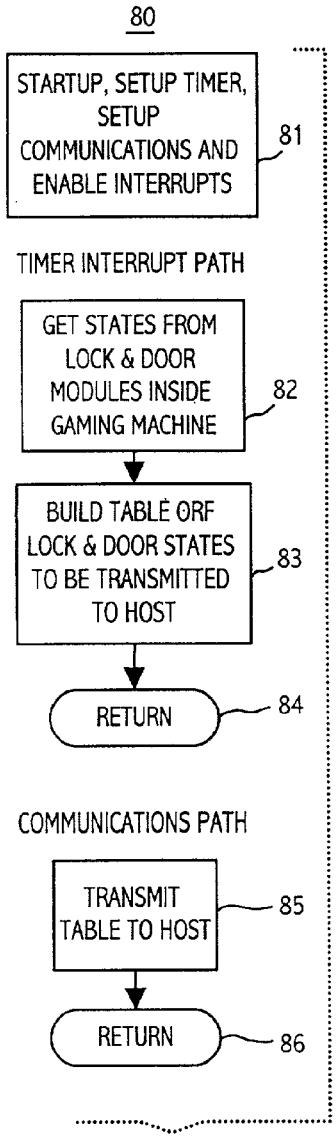
FIG. 11 is a flow chart diagram of program software for a local processor of one of the gaming machines of FIG. 1.
Figure 10:
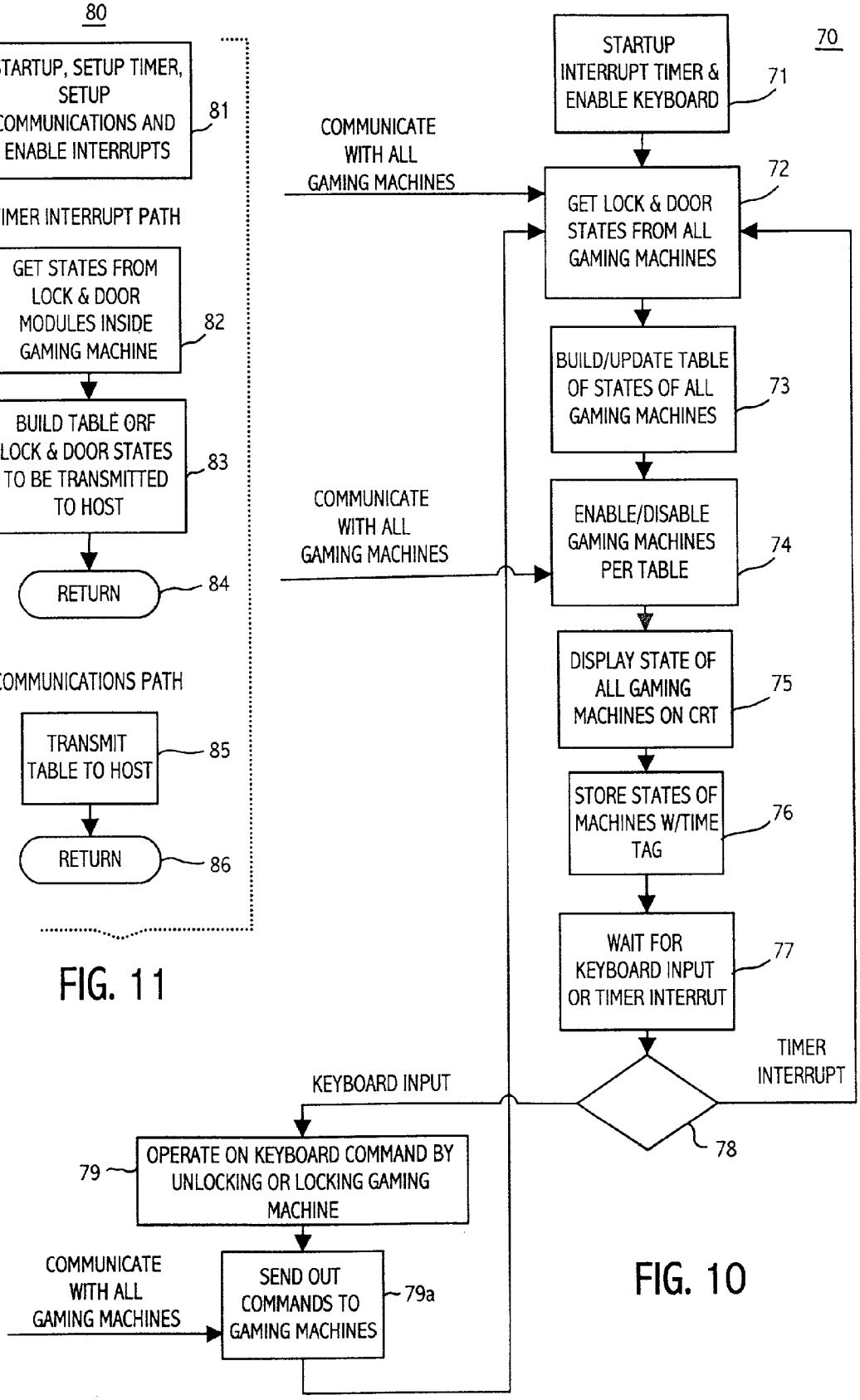
FIG. 10 is a flow chart diagram of program software for the host computer of the system of FIG. 1.

Referring to FIGS. 10-12, the operation of the system 20 will be described in greater detail. FIG. 10 illustrates a flow chart 70 for a software program of the host computer 21 in connection with the access control system 20 described herein. Initially, at 71, the input devices 26, such as a keyboard, are enabled, all variables are initialized, all tables are read from storage and all communication ports are initialized and timers are set and interrupts enabled. Then, at 72, communication is established to all of the gaming machines 30 and information is gathered from the lock processors 60 via the local controllers 31. Next, at 73, the routine builds a new table containing the states of all of the lock bolts and doors from the information received from the individual gaming machines. The date and time of day may be added to the table for histogram purposes. Then, at 74, the routine again communicates with all of the gaming machines 30 and control signals are sent thereto to enable or disable of the lock mechanisms 40 thereof in accordance with the table at 73.

Then, at 75, the system displays the states of all of the gaming machines on the display 27 and may produce messages on the display if any states are changed from the previous table. Messages may be steady state or flashing and in various colors, depending upon the particular condition detected. Then, at 76, the new table is stored and if there are any changes from the old table to the new, the new table is added to the end of the file containing the old table. Then, at 77 the program loops and waits for an input from the input devices 26 or a timer interrupt. If, at 78, a timer interrupt is received, the program returns to 72, and if a key board or other input device input is received, it proceeds to 79 and utilizes the input commands to build messages to send to the gaming machines for locking or unlocking different lock mechanisms in accordance with the commands and then, at 79*a*, communicates those messages to the gaming machines and returns to 72. These commands are communicated as CNS or CSN signals to the coil 45*a* of the designated lock mechanism 40 of the designated gaming machines 30 for respectively locking or unlocking the lock bolt 42.

It will be appreciated that, with the use of this program the system 20 can readily detect error or fault conditions in the states of the gaming machines 30. For example if a door 50 is open, but its associated lock bolt 42 is in its locked position, this would be an error condition which would merit investigation. Similarly, if a lock bolt 42 were to remain in neither a locked nor an unlocked condition, this would be recognized as a fault condition. Also, the system can readily determine whether or not the sensed states of the machine are in accordance with the most recently commanded states and indicate any discrepancies.

In FIG. 11 there is illustrated a flow chart for a software program 80 for the processor 32 of a local controller 31. At 81, the timers, interrupts and communications port are enabled. The timer is used to interrupt the controller so that data from all of the lock mechanism 40 of the machine 30 can be gathered at regular intervals. The communications port is used to communicate with the host computer 21. At 82, when the interrupt timer times out, the controller communicates with the various lock mechanisms 40 to gather the states of the doors and lock mechanism via the optical emitters and receivers and then, at 83, builds a table of these lock and door states to be transmitted to the host computer 83 and then returns at 84 to the main loop. When the program sees a communications interrupt from the host computer 21 at 85, it transmits the table built at 83 to the host 21 and then returns at 86 to the main loop.

Referring to FIG. 12 there is illustrated a software program 90 for a lock processor 60 of FIG. 3. At 91 the program sets up timer and communications interrupts and then loops waiting for a timer or communication interrupt to occur. The beginning of a timer interrupt subroutine is designated 92, in which the routine first checks at 93 to see if the lock bolt coil 45*a* of a lock mechanism to be mounted is energized. If it is, the system recognizes at 94 that the condition of the lock bolt is changing, and then at 95 sets a changing state timer and, when it times out, exits at 96 back to 93 to again check to see if the coil is energized. The program will go through this loop ten times and, on the tenth time will produce an error code indicating a fault. If, at 93, the coil is not energized, then the bolt is not changing states and the system should be able to get a good reading from the sensors, so the system proceeds to 97 to check to see if the lock/door combination are in a state 1, wherein the lock bolt is in its unlocked condition and the associated door is in its opened condition, which would be a service state condition. If so, the routine, at 98, sets the service state flag and proceeds to 99 to add that state to the table of states of lock and door sensors and then returns at 100 to the main loop.

If, at 97, the lock/door combination is not in state 1, the routine checks at 101 to see if it they are in a state 2, corresponding to the bolt in its unlocked condition and the door closed, which is another service state condition. If so, the routine again proceeds to 98 and, if not, next checks at 102 to see if they are in state 3, corresponding to the lock locked and the door closed, which is the normal operating state. If so, the routine, at 103, sets the lock locked and door closed flag. If not, the routine next checks at 104 to see if the door/lock combinations in state 4, corresponding to the lock locked and the door opened, which is an error state. If so, the routine, at 105 sets the corresponding flag.

Note that each door/lock combination has two acceptable lock bolt conditions, i.e., locked or unlocked, and two acceptable door conditions, i.e., closed or opened. This means there are four possible combinations of lock/door conditions and the routine checks at tests 93, 101, 102, and 104 for each of those four conditions in sequence. If, at 104, the answer is no, it means that none of those four acceptable conditions obtains and, therefore, the lock must be broken or has been tampered with. This could be because the lock bolt is stuck or it may be because someone has opened the lock with a manual key, such as the override key, and when that occurs the lock must be taken apart and pieces reset, such as resetting the position of the prism 66 (FIG. 9(*d*).

Thus the routine then proceeds to 106 to check the nature of the fault condition. If the sensors are signaling that the lock is both locked and unlocked, the routine then checks at 107 to see whether the door is opened or closed and sets an appropriate flag at 108 or 109 and then proceeds to 99. If, at 106, the sensors indicate that the lock bolt is neither locked nor unlocked, the routine then checks at 110 to seek what condition the door is in and sets the appropriate flag at 111 or 112 and then proceeds to 99. When the fault code is generated at 96, indicating that the coil has remained energized, the routine also moves to 106 to signal a broken lock condition.

If a communication interrupt occurs, the routine at 113 transmits the table built at 99 to the local controller 31 for the gaming machine 30, and then returns at 114 to the main loop.

In overall operation, when a person wishes to obtain access to any locked area of a gaming machine 30, the person first inputs his or her personnel identification information, utilizing the input device 35. The local controller 35 then communicates this information to the host computer 21, which compares it with the database 24 to determine which, if any, of the locked areas of the gaming machine 30 the person is entitled to access. If access is authorized for one or more areas, signals are sent back to the gaming machine 30 for controlling corresponding lock mechanisms to unlock those areas. When access is completed and the door is reclosed or the switch or other device is returned to its initial condition, this information will also be communicated back to the host computer, which send signals to can then relock the lock mechanisms.

The gaming machines 30 can also be controlled from the host computer 21 independently of any local access request. Thus, for example, if it is desired to provide a service function on a group of machines, such as drop box emptying or hopper loading, that group of machines is typically roped off and the host computer unlocks the appropriate locking mechanisms so that the service person or team can perform the appropriate service function on all of the machines in the group.

A significant advantage of the system 20 is that it greatly facilitates adjustment of the security system to accommodate changes in personnel or their assigned duties. Thus, if a new employee is hired or an existing employee is terminated or an employee's duties are changed so as to alter the machines or the areas thereof to which access authorization by the employee is required, all that need be done is an appropriate editing of the database 24 and the issuance of a new personal data card 37. Similarly, if a card is lost, changing of the identification code for the person involved and the re-issuance of a new card is a simple matter. No change in a physical lock mechanism of any gaming machine is required.

While, in the embodiment described above, the database 24 is stored at the host computer 21, it will be appreciated that it could also be stored at the local controller 31 of each gaming machine 30. However, in this case, any database changes would have to also be affected at gaming machine. Also, while in the illustrated embodiment only personnel identification data is stored on the personal data card 37, it would also be possible to store access authorization data on the card 37 so that when the card is input to a card reader at a gaming machine 30, all areas of that machine to which access is authorized by the card holder could and directly be unlocked without intervention of the host computer.

Various types of input devices 35 have been mentioned above. One possible alternative could be the use of an RF device. In some gaming establishments, it is currently known to have floor personnel to carry a device, such as a hand-held, pocketable computing device of the type sold under PALM trademark, by which they can communicate through an RF link with a similar device in a gaming machine for control of certain functions. It would be possible to utilize such a device as the local controller 31 of a gaming machine, and to have the unit hand-held by establishment personnel serve the function of the input device 35. Such a device within the gaming machine 30 could communicate with a similar device at a host location over an RF communications link, and could communicate by a wired link, such as an RS232 link, to the individual lock mechanism control/monitor circuits 41.

The matter set forth in the foregoing description and accompanying drawings is offered by way of illustration only and not as a limitation. While particular embodiments have been shown and described, it will be obvious to those skilled in the art that changes and modifications may be made without departing from the broader aspects of applicants' contribution. The actual scope of the protection sought is intended to be defined in the following claims when viewed in their proper perspective based on the prior art.

What is claimed is:

1. Apparatus for remotely selectively controlling access to a plurality of physical areas of a plurality of gaming machines, the apparatus comprising:

a plurality of electrically operable lock mechanisms, each respectively associated with one of the plurality of physical areas of each of the gaming machines;

each of said lock mechanisms being physically movable between unlocked and locked conditions with respect to its associated area;

control circuitry independent of the gaming machines, said control circuitry including a processor operating under control of a stored program and coupled to each of said lock mechanisms via a communications link for controlling operation thereof;

a data storage and retrieval system adapted to communicate with the processor and including a storage medium for storing data including personnel identification data and access authorization data indicative of the gaming machines and the physical areas, if any, of each of the gaming machines for which a person seeking access to the gaming machines is authorized; and a data input device coupled to the processor, said data input device enabling a person to input at least personnel identification data that identifies the person, the processor being operable to compare said personnel identification data inputted by the person with said personnel identification data stored by said storage media that authorizes access by certain, identified personnel to certain designated gaming machines of the plurality of gaming machines and to a plurality, but not all, of said physical areas of said designated gaming machines, and cause the lock mechanisms of the plurality of physical areas to move to the unlocked position to allow access to those plurality of physical areas of the designated gaming machines when the personnel identification data inputted by the person matches any of the personnel identification data stored by said storage medium, wherein at least one of the lock mechanisms includes a solenoid having a plunger, the plunger being moveable between a retracted position when the solenoid is energized to enable a mechanical key to be used to unlock said lock mechanism, and an extended position when the solenoid is de-energized to prevent the mechanical key from being used to unlock said lock mechanism.

2. A method of remotely selectively controlling access to a plurality of different, physical areas of a plurality of gaming machines, the method comprising:

providing each of the plurality of physical areas with an electrically operable lock mechanism which is physically movable between unlocked and locked conditions;

storing data including personnel identification data and access authorization data indicative of the particular gaming machines and the physical areas, if any, of the particular gaming machines for which a person seeking access to the gaming machines is authorized;

controlling the operation of the lock mechanisms via a processor independent of the gaming machines, said processor being coupled to each lock mechanism;

inputting at least personnel identification information into a data input device that identifies a person seeking access to a plurality of said physical areas of the plurality of gaming machines;

comparing said inputted personnel identification data with at least said stored personnel identification data; and remotely, electrically unlocking a plurality of the lock mechanisms of only those plurality of physical areas, less than all of said physical areas, of the particular gaming machines, for which the person seeking access is authorized when said inputted personnel identification data matches any of the personnel identification data stored by said storage medium, providing at least one of the lock mechanisms with a solenoid having a plunger, wherein the plunger is moveable between a retracted position when the solenoid is energized to enable a mechanical key to be used to unlock said lock mechanism, and an extended position when the solenoid is de-energized to prevent the mechanical key from being used to unlock said lock mechanism.

3. Apparatus for remotely selectively controlling access to a plurality of physical areas of a plurality of gaming machines, the apparatus comprising:

a plurality of electrically operable lock mechanisms, each respectively associated with one of the plurality of physical areas of each of the gaming machines and each lock mechanism physically movable between unlocked and locked conditions with respect to its associated area;

control circuitry independent of the gaming machines, said control circuitry including a processor operating under control of a stored program and coupled to each of the lock mechanisms of the gaming machines via a communications link for controlling operation thereof; and a data storage and retrieval system adapted to communicate with the processor and including a storage medium for storing data including personnel identification data and access authorization data indicative of certain designated gaming machines and the physical areas, if any, of the designated gaming machines for which a person seeking access to the gaming machines is authorized;

the processor being operable to compare personnel identification data inputted by a person into a data input device with said personnel identification data stored by said storage medium that authorizes access by certain, identified personnel to at least one of the physical areas of each of the designated gaming machines, and cause the lock mechanisms of the physical areas at each of the designated gaming machines to which access is authorized to move to the unlocked position to allow access to those physical areas of the designated gaming machines when said inputted personnel identification data matches any of the personnel identification data stored by said storage medium, wherein at least one of the lock mechanisms includes a solenoid having a plunger, the plunger being moveable between a retracted position when the solenoid is energized to enable a mechanical key to be used to unlock said lock mechanism, and an extended position when the solenoid is de-energized to prevent the mechanical key from being used to unlock said lock mechanism.

* * * * *